US010618067B2

(12) United States Patent
Sato et al.

(10) Patent No.: US 10,618,067 B2
(45) Date of Patent: Apr. 14, 2020

(54) ELECTROSTATIC SPRAY DEVICE AND ELECTROSTATIC SPRAY METHOD

(71) Applicant: ANEST IWATA Corporation, Kanagawa (JP)

(72) Inventors: Kazuaki Sato, Kanagawa (JP); Shoji Kakizaki, Kanagawa (JP)

(73) Assignee: ANEST IWATA CORPORATION, Kanagawa (JP)

( * ) Notice: Subject to any disclaimer, the term of this patent is extended or adjusted under 35 U.S.C. 154(b) by 0 days.

(21) Appl. No.: 15/774,796

(22) PCT Filed: Nov. 9, 2016

(86) PCT No.: PCT/JP2016/083187

§ 371 (c)(1),
(2) Date: May 9, 2018

(87) PCT Pub. No.: WO2017/082279

PCT Pub. Date: May 18, 2017

(65) Prior Publication Data

US 2018/0318857 A1 Nov. 8, 2018

(30) Foreign Application Priority Data

Nov. 9, 2015 (JP) ..... 2015-219610

(51) Int. Cl.
*B05B 5/043* (2006.01)
*B05D 1/04* (2006.01)
(Continued)

(52) U.S. Cl.
CPC ..... *B05B 5/043* (2013.01); *B05B 5/035* (2013.01); *B05B 5/08* (2013.01); *B05B 15/5225* (2018.02); *B05D 1/04* (2013.01); *B05B 1/06* (2013.01)

(58) Field of Classification Search
CPC ..... B05B 5/043; B05B 5/08; B05D 1/04
(Continued)

(56) References Cited

U.S. PATENT DOCUMENTS 4,748,043 A 5/1988 Seaver et al.
6,457,470 B1 * 10/2002 Coffee ..... A61M 15/0091 128/200.14

(Continued)

FOREIGN PATENT DOCUMENTS

CA 1 224 982 8/1987
DE 33 25 070 1/1985

(Continued)

OTHER PUBLICATIONS

Extended European Search Report dated Jun. 4, 2019 in corresponding European Patent Application No. 16864240.3.

(Continued)

*Primary Examiner* — Christopher S Kim
(74) *Attorney, Agent, or Firm* — Wenderoth, Lind & Ponack, L.L.P.

(57) ABSTRACT

An electrostatic spray device includes a liquid sprayer including a nozzle that spouts a liquid; a voltage applicator that applies a voltage between the liquid sprayer and a heteropolar portion functioning as a pole opposite a pole of the liquid sprayer to generate an electrostatic force for causing the liquid to separate from a distal end of the nozzle in a charging state; and a stabilization electrode that maintains a stable spraying state of the liquid even when a pressure is applied to the liquid to supply the nozzle with the liquid. The stabilization electrode has an electric potential identical to an electric potential of the liquid sprayer, and is disposed near the nozzle such that a jet portion formed at a front of the nozzle by a linear extension of the liquid has a length longer than a length of the jet portion before the stabilization electrode is provided.

19 Claims, 9 Drawing Sheets

(51) Int. Cl.

| | |
|---|---|
| ***B05B 15/522*** | (2018.01) |
| ***B05B 5/035*** | (2006.01) |
| ***B05B 5/08*** | (2006.01) |
| *B05B 1/06* | (2006.01) |

(58) Field of Classification Search
USPC ..... 239/690, 704–708
See application file for complete search history.

(56) References Cited

U.S. PATENT DOCUMENTS

| | | | |
|---|---|---|---|
| 2009/0140083 | A1 | 6/2009 | Seitz |
| 2014/0160207 | A1 | 6/2014 | Byun et al. |

FOREIGN PATENT DOCUMENTS

| | | |
|---|---|---|
| EP | 1 832 349 | 9/2007 |
| EP | 2 851 128 | 3/2015 |
| GB | 749008 | 5/1956 |
| JP | 48-1031 | 1/1973 |
| JP | 63-69555 | 3/1988 |
| JP | 8-153669 | 6/1996 |
| JP | 2007-167761 | 7/2007 |
| JP | 2009-202131 | 9/2009 |
| JP | 2014-94565 | 5/2014 |
| WO | 89/12509 | 12/1989 |

OTHER PUBLICATIONS

International Search Report dated Jan. 24, 2017 in International (PCT) Application No. PCT/JP2016/083187.

* cited by examiner

ELECTROSTATIC SPRAY DEVICE AND ELECTROSTATIC SPRAY METHOD

TECHNICAL FIELD

The present invention relates to an electrostatic spray device.

BACKGROUND ART

There has been known an electrostatic spray head for discharging fine particles that includes capillary needles and a surrounding surface, each of which at least has a semi-conductive property, and that atomizes liquid in a needle-shaped orifice by application of an electrical potential between the capillary needles and the surrounding surface (see Japanese Unexamined Patent Application Publication No. S63-069555). In this electrostatic spray coating head, a conductor plate (21) supports a large number of capillary needles (11) located in at least two rows such that the distal ends of the capillary needles (11) are positioned in an identical plane. A conductive extractor plate (14) having a large number of circular holes (13) is disposed such that each of the holes (13) is disposed concentrically with respect to one of the needles. The extraction plate (14) is located away from the conductive plate (21) by a constant distance and generates uniform discharge of mist of liquid from the needles (11). A manifold device (15) communicating with the capillary needles (11) supplies the liquid to the rows of the capillary needles (11), and an electrical device (Vi) generates an electrical potential between the respective capillary needles (11) and the extraction plate (14). This gives a thin coating on a web.

In the device like the above-described Japanese Unexamined Patent Application Publication No. S63-069555, which generates the electrical potential (an electrostatic force) to spout the liquid from the capillary needles (nozzles) and spray the liquid, supplying a large amount of liquid to the nozzles generally makes an atomization state (such as a state of a particle diameter of the liquid to be sprayed) of the liquid unstable, and a state where the liquid is not atomized occurs at the worst.

Meanwhile, when the liquid such as a coating material is applied over a coated object, a time taken for the application of the liquid to the coated object can be shortened as an amount of the sprayed liquid increases. Accordingly, the increase in the amount of supplied liquid has been requested.

However, increasing the amount of supplied liquid generates a variation of the particle diameter of the liquid to be sprayed as described above, causing a problem of unevenness of application. When the liquid is in the state of not being atomized, coating the liquid to the coated object itself becomes difficult.

The present invention has been made in consideration of such circumstances, and an object of the present invention is to provide an electrostatic spray device and an electrostatic spray method that ensure stable atomization even when an amount of supplied liquid is large.

Solution to Problem

In order to achieve the object, the present invention has, for example, the following aspects.

(1) An electrostatic spray device according to one embodiment of the present invention includes a liquid spray unit, voltage application unit, and a stabilization electrode. The liquid spray unit includes a nozzle spouting a liquid. The voltage application unit is configured to apply a voltage between the liquid spray unit and a heteropolar portion to generate an electrostatic force causing the liquid to separate from a distal end of the nozzle in a charging state. The heteropolar portion functions as a pole opposite from a pole of the liquid spray unit. The stabilization electrode is configured to maintain a stable spraying state in which the liquid is stably sprayed with a maximum grain diameter of a particle diameter (i.e., a maximum liquid particle grain diameter) of 100 μm or less in a steady spraying even when a pressure is applied to the liquid to supply the nozzle with the liquid. The stabilization electrode has an electric potential identical to an electric potential of the liquid spray unit. The stabilization electrode is disposed near the nozzle such that a jet portion formed at a front of the nozzle by a linear extension of the liquid has a length longer than a length of the jet portion before the stabilization electrode is provided.

(2) In the above-described configuration (1), the stabilization electrode lengthens the length of the jet portion by 1.5 times or more compared with the length before the stabilization electrode is provided.

(3) In the above-described configuration (1) or (2), the stabilization electrode sets a spraying state of the liquid in the stable spraying state even when the pressure is applied to the liquid to supply the nozzle with the liquid exceeding 0.2 milliliters per minute.

(4) In any one of the above-described configurations (1) to (3), the stabilization electrode sets the spraying state of the liquid in the stable spraying state even when the pressure is applied to the liquid to supply the nozzle with the liquid with a viscosity of 0.5 Pa·s or more and 1000 mPa·s or less.

(5) In any one of the above-described configurations (1) to (4), the voltage application unit is configured to apply a voltage of 10 kV or more.

(6) In any one of the above-described configurations (1) to (5), the stabilization electrode includes a distal end portion having an approximately planar distal end surface and a part having an outer shape approximately identical to an outer shape of the distal end surface from the distal end surface side to a rear side.

(7) In the above-described configuration (6), when a distance from the distal end of the nozzle to the distal end surface of the stabilization electrode is L (μm) and an area of the distal end surface of the stabilization electrode is S ($mm^2$), the following a formula (1) is met.

$$S \geq [L^2 \times F(L)]/10^6 \quad (1)$$

(Note that $F(L)=1.1191\times EXP(L\times 0.00073)$ and when $L\leq 1.0$, $L=1.0$.)

(8) In the above-described configuration (7), the area S is 1250 $mm^2$ or less. The distal end surface of the stabilization electrode is positioned at a position of the distance L (μm) from the distal end of the nozzle, and the distance L (μm) meets the formula (1).

(9) In the above-described configuration (8), the area S is 960 $mm^2$ or less.

(10) In the above-described configuration (8), the area S is 700 $mm^2$ or less.

(11) In any one of the above-described configurations (1) to (5), the stabilization electrode includes a distal end portion having a distal end surface and a part inclined such that an outer shape thereof enlarges from the distal end surface side to a rear side.

(12) In the above-described configuration (11), at least a part of the distal end portion of the stabilization electrode is positioned within 8 mm from the distal end of the nozzle. When a cross-sectional area of a cross section when the distal end portion of the stabilization electrode positioned within 8 mm is cut off at any position in a center axis direction of the nozzle is SS ($mm^2$) and a distance from the distal end of the nozzle to the cross section is LL (μm), the distal end portion positioned within 8 mm from the distal end of the nozzle includes a part having the cross-sectional area SS ($mm^2$) meeting the following formula (2):

$$SS \geq [LL^2 \times F(LL)]/10^6 \quad (2)$$

(Note that F(LL)=1.1191×EXP(LL×0.00073) and when LL≤1.0, LL=1.0).

(13) In the above-described configuration (12), the cross-sectional area SS ($mm^2$) at a part with the largest outer shape of the distal end portion of the stabilization electrode positioned within 8 mm is 1250 $mm^2$ or less.

(14) In the above-described configuration (12), the cross-sectional area SS ($mm^2$) at a part with a largest outer shape of the distal end portion of the stabilization electrode positioned within 8 mm is 960 $mm^2$ or less.

(15) In the above-described configuration (12), the cross-sectional area SS ($mm^2$) at a part with a largest outer shape of the distal end portion of the stabilization electrode positioned within 8 mm is 700 $mm^2$ or less.

(16) In any one of the above-described configurations (1) to (15), the electrostatic spray device further includes a liquid supply unit configured to apply the pressure to the liquid to supply the nozzle with the liquid.

(17) An electrostatic spray method according to one embodiment of the present invention separates a liquid from a distal end of a nozzle and sprays the liquid in a state where the liquid is charged by an electrostatic force generated by an application of a voltage between a liquid spray unit including the nozzle to spout the liquid and a heteropolar portion functioning as a pole opposite from a pole of the liquid spray unit. The electrostatic spray method includes disposing a stabilization electrode having an electric potential identical to an electric potential of the liquid spray unit near an outer periphery of the nozzle, and spraying the liquid by applying a pressure to the liquid to supply the nozzle with the liquid such that a linear extension of the liquid lengthens a length of a jet portion formed at a front of the nozzle longer than a length of the jet portion in a state without the stabilization electrode.

(18) In the above-described configuration (17), the spraying of the liquid includes spraying the liquid such that the jet portion has a length longer than the length of the jet portion without the stabilization electrode by 1.5 times or more.

(19) In the above-described configuration (17) or (18), a supplied amount of the liquid supplied to the nozzle exceeds 0.2 milliliters per minute.

(20) In any one of the above-described configurations (17) to (19), the liquid supplied to the nozzle has a viscosity of 0.5 Pa·s or more and 1000 mPa·s or less.

(21) In any one of the above-described configurations (17) to (20), a voltage applied between the liquid spray unit and the heteropolar portion is 10 kV or more.

According to one embodiment of the present invention, even when an amount of supplied liquid is large, stable atomization is possible.

DETAILED DESCRIPTION OF EMBODIMENTS

Figure 1:
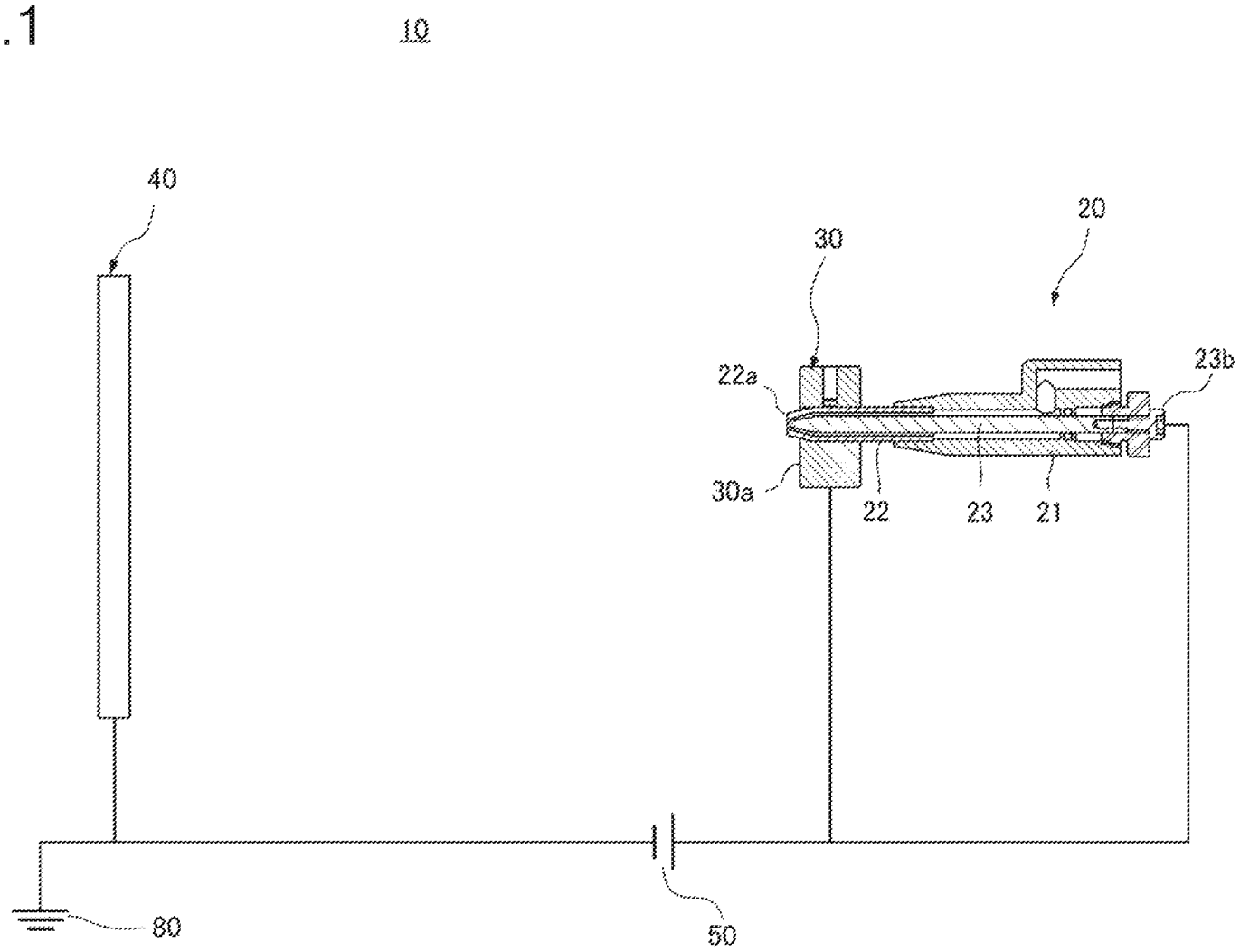
FIG. 1 is a cross-sectional view illustrating an overall configuration of an electrostatic spray device of a first embodiment according to the present invention.

The following explains configurations (hereinafter, embodiments) to embody the present invention in detail with reference to the attached drawings. Like reference numerals designate identical elements throughout the entire explanation of the embodiments. Unless otherwise stated, expressions such as a "distal (end)" and a "front (forward)" represent a spray direction side of liquid in each member and the like and expressions such as a "rear (end)" and a "rear (rearward)" represent a side opposite to the spray direction of the liquid in each member and the like.

First Embodiment

FIG. 1 is a cross-sectional view illustrating an overall configuration of an electrostatic spray device 10 of the first embodiment according to the present invention. As illustrated in FIG. 1, the electrostatic spray device 10 includes a liquid spray unit 20 including a nozzle 22, which spouts liquid, a stabilization electrode 30, and a voltage application unit (a voltage power supply) 50. The voltage application unit 50 applies a voltage between the liquid spray unit 20 and a heteropolar portion 40 functioning as a pole opposite from a pole of the liquid spray unit 20.

(Liquid Spray Unit)

Figure 2:
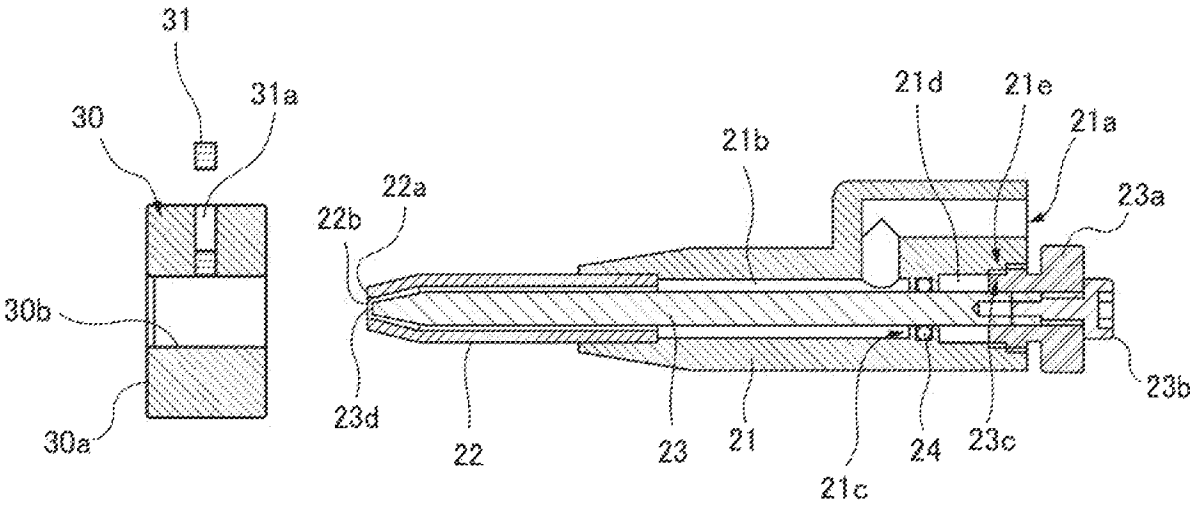
FIG. 2 is an exploded cross-sectional view illustrating a liquid spray unit and a stabilization electrode of the first embodiment.

FIG. 2 is an exploded cross-sectional view disassembling the liquid spray unit 20 and the stabilization electrode 30. As illustrated in FIG. 2, the liquid spray unit 20 includes a body 21, the nozzle 22, and a central rod 23. The body 21 is made from an insulating material, and a liquid flow passage 21*b* is formed inside the body 21. The liquid flow passage 21*b* includes a liquid supply port 21*a* from which the liquid is supplied. The nozzle 22 has a through-hole disposed on the distal end of the body 21 so as to communicate with the liquid flow passage 21*b* in the body 21. The central rod 23 is made from a conductive material and is located inside the liquid flow passage 21*b* in the body 21 and inside the through-hole on the nozzle 22.

The body 21 has a hole portion 21*c* communicating with the liquid flow passage 21*b* to take out the central rod 23 to the rear end side. A sealing member 24 for sealing a clearance with the central rod 23 to prevent a leakage of the liquid is provided in the hole portion 21*c*. While this embodiment uses an O-ring as the sealing member 24, the sealing member 24 is not limited to the O-ring but any member that can perform the sealing is usable.

A knob portion 23*a* made from an insulating material and an electrical wiring connecting portion 23*b* made from a conductive material are disposed at the rear end of the central rod 23 positioned on the rear end side of the body 21. The electrical wiring connecting portion 23*b* is disposed so as to penetrate an approximately center of the knob portion 23*a*.

As illustrated in FIG. 1, an electrical wiring from the voltage application unit 50 is coupled to the electrical wiring connecting portion 23*b*. As illustrated in FIG. 2, locating the electrical wiring connecting portion 23*b* so as to contact the central rod 23 electrically connects the central rod 23 to the electrical wiring connecting portion 23*b*.

Additionally, a female screw structure 21*e* for threaded connection of the knob portion 23*a* is provided on an inner peripheral surface of a rear end opening 21*d* of the body 21. Meanwhile, a male screw structure 23*c* is provided on an outer peripheral surface at the distal end of the knob portion 23*a*.

Accordingly, by a threaded engagement of the male screw structure 23*c* on the outer peripheral surface at the distal end of the knob portion 23*a* with the female screw structure 21*e* on the rear end opening 21*d* of the body 21, the central rod 23 is removably mounted to the body 21. Further, adjusting an amount of screwing of the knob portion 23*a* allows the central rod 23 to be moved in the front-rear direction, thereby ensuring adjusting a position of a distal end surface 23*d* of the central rod 23 in the front-rear direction.

Here, generally, a nozzle of an electrostatic spray device spraying liquid includes a fine liquid flow passage having a small-diameter through-hole through which the liquid flows. This is inferred because the large opening diameter of the distal end of the nozzle from which the liquid flows out possibly fails to obtain a stable atomization state of the liquid. For example, the opening diameter of the distal end of the nozzle is generally less than 0.1 mm.

In view of this, for example, when the liquid dries, the opening at the distal end of the nozzle immediately clogs. There is a problem that solving this clogging is difficult due to the reduced opening diameter.

However, although the reason will be explained later, the inventors of the present application have found that the use of the central rod 23 ensures good atomization even when the opening diameter of the distal end of the nozzle is large compared with the conventional one. This allows the opening diameter of a distal opening 22*b* at the distal end of the nozzle 22 of this embodiment to be large (for example, 0.2 mm). Consequently, a frequency of a clogging can be significantly lowered.

The opening diameter of the opening 22*b* of the nozzle 22 is not limited to 0.2 mm but the opening diameter may be around 1 mm in the configuration using the central rod 23.

The opening diameter of the opening 22*b* of the nozzle 22 is 0.1 mm or more in one embodiment, 0.2 mm or more in another embodiment, and larger than 0.2 mm in yet another embodiment. The clogging is less likely to occur in these embodiments and even if the clogging occurs, cleaning can be performed.

Meanwhile, the opening diameter of the opening 22*b* of the nozzle 22 is 1.0 mm in one embodiment, 0.8 mm or less in another embodiment, and 0.5 mm or less in yet another embodiment. These embodiments can stabilize the atomization.

In this embodiment, the central rod 23 can be moved in the front-rear direction as described above. In view of this, even if the clogging occurs, moving the central rod 23 ensures solving the clogging. Furthermore, the inner diameter of the through-hole of the nozzle 22 is large enough that the central rod 23 can be disposed therein. This allows removing and washing the central rod 23 by flowing a large amount of cleaning fluid.

Figure 3B:
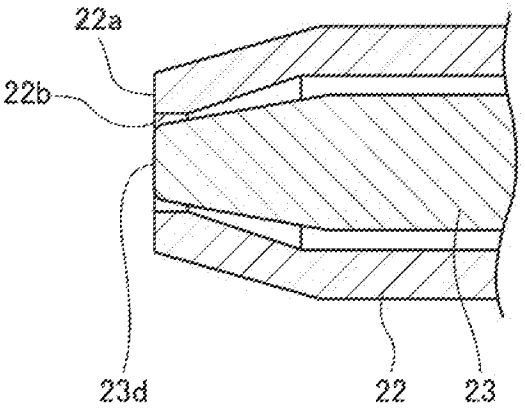
FIG. 3B is a partially enlarged cross-sectional view enlarging the distal end side of the liquid spray unit of the first embodiment and illustrates the case when the distal end surface of the central rod is positioned forward with respect to the state of FIG. 3A.
Figure 3A:
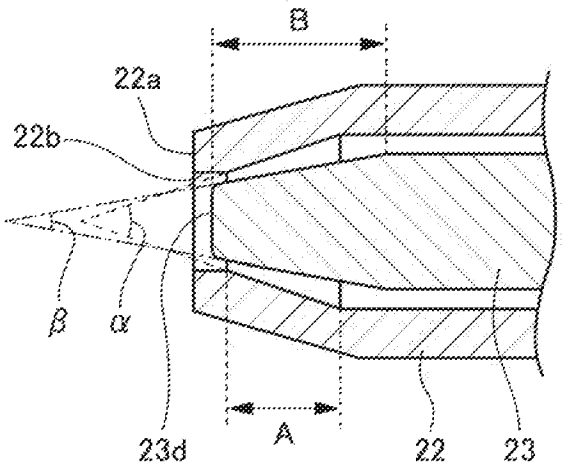
FIG. 3A is a partially enlarged cross-sectional view enlarging a distal end side of the liquid spray unit of the first embodiment and illustrates the case when a distal end surface of a central rod is positioned rearward.

FIG. 3A and FIG. 3B are enlarged views enlarging the distal end side of the liquid spray unit 20. FIG. 3A illustrates the case where the distal end surface 23*d* of the central rod 23 is positioned rearward. FIG. 3B illustrates the case where the distal end surface 23*d* of the central rod 23 is positioned forward relative to the state shown in FIG. 3A.

As illustrated in FIG. 3A, the nozzle 22 has a tapered inner diameter portion (see a range A) whose inner diameter decreases in a tapered shape toward the distal opening 22*b*. The taper angle of this tapered inner diameter portion is $\alpha$. The central rod 23 has a tapered portion (see a range B) whose outer diameter decreases toward the distal end surface 23*d*. The taper angle of the tapered portion is $\beta$.

The taper angle $\alpha$ of the tapered inner diameter portion of the nozzle 22 is larger than the taper angle $\beta$ of the tapered portion of the central rod 23. The distal end surface 23*d* of the central rod 23 has the diameter smaller than the opening diameter of the opening 22*b* of the nozzle 22. The tapered portion of the central rod 23 is formed so as to have the diameter gradually enlarging toward the rear end side and have a part with the diameter larger than the opening diameter of the opening 22*b* of the nozzle 22.

As described above, by forming the distal end sides of the nozzle 22 and the central rod 23, as is apparent from a comparison between FIG. 3A and FIG. 3B, moving the central rod 23 in the front-rear direction allows an adjustment of a width of a clearance formed between the nozzle 22 and the central rod 23. Consequently, the amount of liquid coming out from the opening 22*b* of the nozzle 22 is adjustable.

The additional movement of the central rod 23 to the front side with respect to the state illustrated in FIG. 3B causes the central rod 23 to abut on the inner peripheral surface of the nozzle 22, thus ensuring blocking the opening 22*b* of the nozzle 22. Accordingly, blocking the opening 22*b* of the nozzle 22 with the central rod 23 while the liquid is not sprayed ensures preventing the liquid inside the nozzle 22 from drying. Consequently, the clogging of the nozzle 22 can be reduced.

(Stabilization Electrode)

As illustrated in FIG. 2, the stabilization electrode 30 has a screw hole 31*a* where a female screw structure is provided. After the stabilization electrode 30 is mounted on the nozzle 22 of the liquid spray unit 20, a fixation screw 31 is screwed into the screw hole 31*a* on the stabilization electrode 30 and the fixation screw 31 is fastened so as to press the outer periphery of the nozzle 22, thus securing the stabilization electrode 30 to the nozzle 22.

Figure 4:
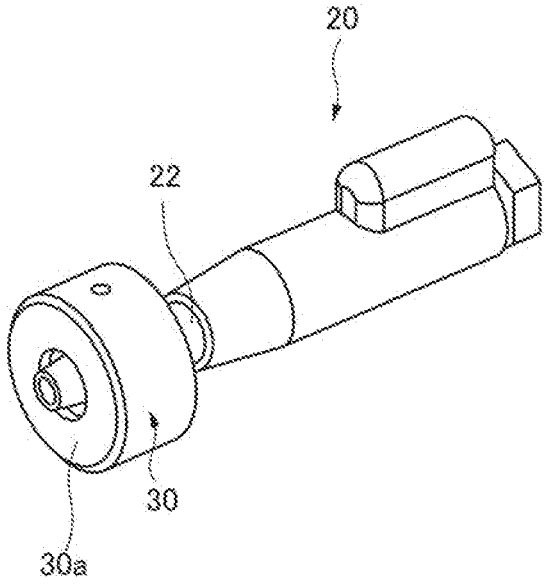
FIG. 4 is a perspective view illustrating the liquid spray unit of the first embodiment.

Thus, as illustrated in FIG. 4, the stabilization electrode 30 is mounted so as to be located near the outer periphery at the distal end of the nozzle 22 of the liquid spray unit 20. More specifically, in this embodiment, as illustrated in FIG. 1, the stabilization electrode 30 is secured to the outer periphery of the nozzle 22 such that a distal end surface 30*a* of the stabilization electrode 30 is located rearward (upstream) with respect to a distal end outer peripheral edge 22*a* of the nozzle 22.

As described above, since the stabilization electrode 30 is secured with the fixation screw 31, loosening the fixation screw 31 ensures movement of the stabilization electrode 30 so as to run along the nozzle 22. In view of this, the position of the stabilization electrode 30 is adjustable in the front-rear direction along the nozzle 22.

While the stabilization electrode 30 is secured to the nozzle 22 in this embodiment, the stabilization electrode 30 may be secured to the body 21 of the liquid spray unit 20. In this case, the stabilization electrode 30 may be located near the outer periphery on the distal end side of the nozzle 22 by an arm structure or a similar structure.

A male screw structure may be formed on the outer peripheral surface of the nozzle 22. A female screw structure may be formed on the inner peripheral surface of a through-hole 30*b* (see FIG. 2) on the stabilization electrode 30 where the nozzle 22 is to be located. In this case, the stabilization electrode 30 may be located near the outer periphery on the distal end side of the nozzle 22 by threaded connection of the stabilization electrode 30 to the nozzle 22. In such threaded connection as well, changing an amount of screwing allows adjustment of the position of the stabilization electrode 30 in the front-rear direction along the nozzle 22.

The stabilization electrode 30 is made from a conductive material. As illustrated in FIG. 1, an electrical wiring branched from the electrical wiring coupling the voltage application unit 50 and the electrical wiring connecting portion 23*b* is coupled to the stabilization electrode 30. Accordingly, the stabilization electrode 30 has an electric potential identical to that of the liquid spray unit 20 (more specifically, the central rod 23).

(Heteropolar Portion 40)

This embodiment uses a coated object as the heteropolar portion 40. The electrical wiring is coupled to the coated object on the side opposite to the side coupled to the central rod 23, and this causes the coated object itself to function as a pole opposite from a pole of the liquid spray unit 20. The coated object functioning as the heteropolar portion 40 is grounded by a grounding portion 80. Although not essential, this grounding portion 80 is provided for safety in case a worker possibly touches the coated object.

To cause the coated object to function as the heteropolar portion 40, this embodiment couples the electrical wiring from the voltage application unit 50 to the coated object. Note that it is not necessary to directly couple the electrical wiring to the coated object.

For example, in the case where the coated object is conveyed to a position at which liquid such as a coating material is applied by a conveying device or a similar device, the electrical wiring from the voltage application unit 50 may be coupled to a support portion of the conveying device on which the coated object is placed to cause the support portion to function as the heteropolar portion 40. Furthermore, the coated object may be electrically connected to the voltage application unit 50 when the coated object contacts the support portion such that the coated object has the electric potential identical to that of the support portion functioning as the heteropolar portion 40.

Figure 5:
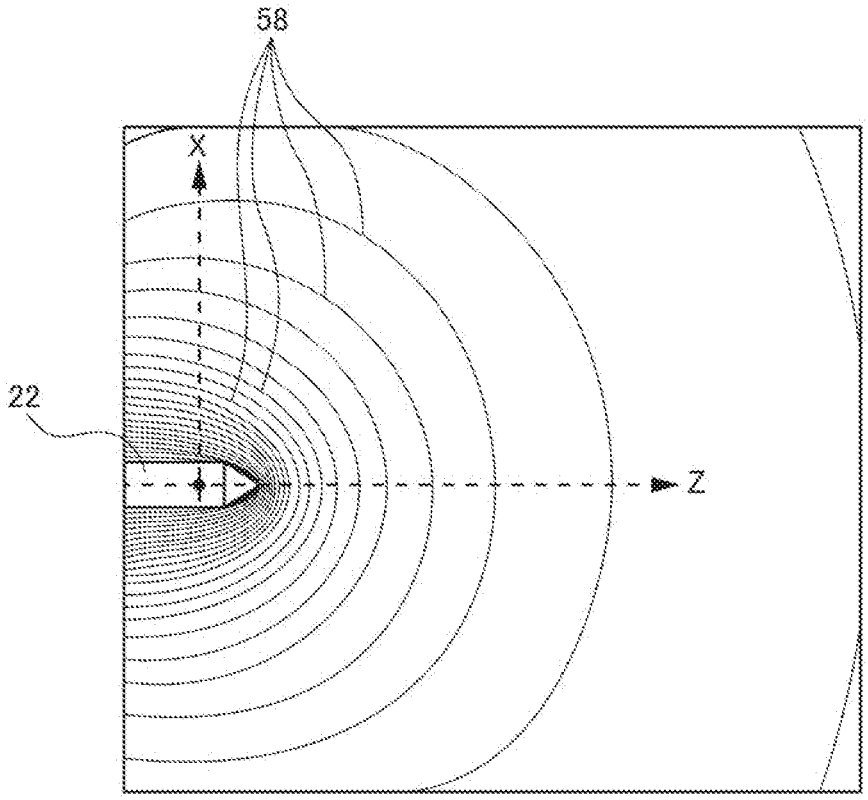
FIG. 5 is a drawing illustrating equipotential curves when a voltage is applied without the stabilization electrode in the electrostatic spray device of the first embodiment.
Figure 6:
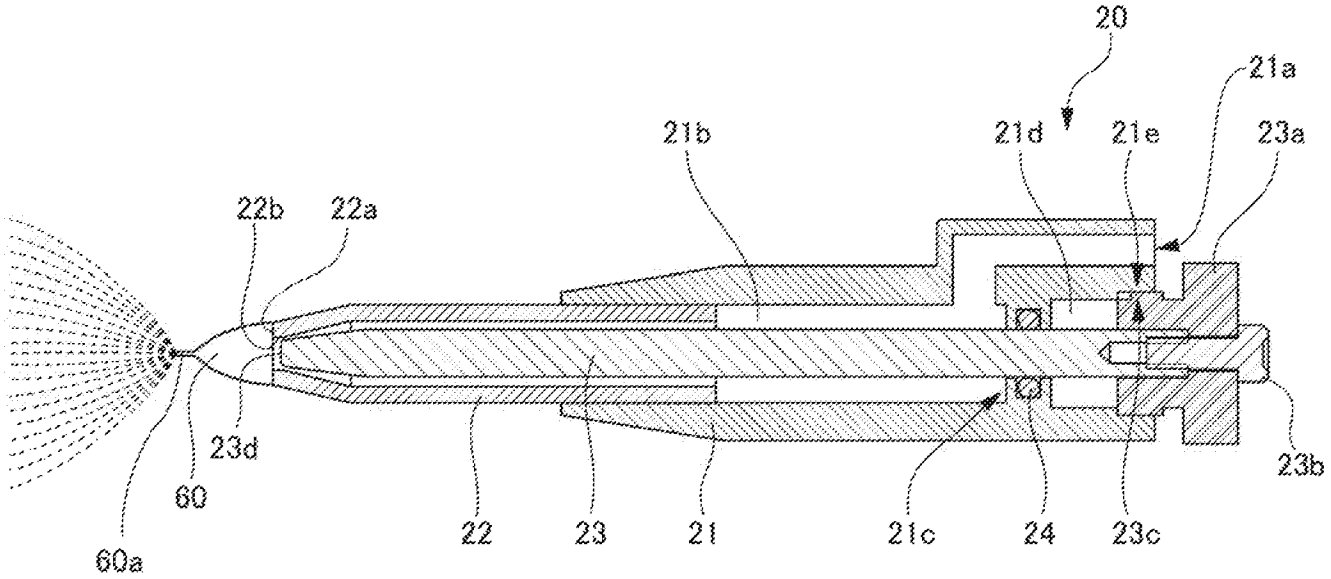
FIG. 6 is a drawing illustrating a state of the liquid spray unit when the liquid is sprayed without the stabilization electrode in the electrostatic spray device of the first embodiment.

Next, the following explains the case where the liquid is sprayed using the liquid spray unit 20 (see FIG. 6) before the stabilization electrode 30 is provided, and explains effects and the like brought by providing the above-described central rod 23 with reference to FIG. 5 and FIG. 6. After that, the following explains effects and the like brought by providing the stabilization electrode 30. FIG. 5 is a side view illustrating only the distal end side of the nozzle 22 spraying the liquid in the state without the stabilization electrode 30.

FIG. 5 illustrates a center axis of the nozzle 22 as a Z-axis and illustrates one axis perpendicular to this Z-axis as an X-axis. FIG. 5 also illustrates equipotential curves 58, which appear on a cross-sectional surface along the Z-axis and the X-axis when a voltage is applied. While the equipotential curves 58 on the X-Z plane are illustrated here as one example, the similar equipotential curves appear on any plane after rotating this plane by a predetermined angle around the Z-axis. FIG. 6 illustrates the state of spraying the liquid from the liquid spray unit 20 without the stabilization electrode 30.

As illustrated in FIG. 5, applying the voltage causes the equipotential curves 58 to appear so as to surround the nozzle 22. The liquid coming out from the nozzle 22 is drawn in a direction perpendicular to tangents of the equipotential curves 58 by electrostatic force. At this time, the electrostatic force drawing the liquid is balanced with surface tension to the distal end surface 23*d* of the central rod 23 and the distal end outer peripheral edge 22*a* of the nozzle 22 and an adhesive force by viscosity. This forms the liquid supplied to the distal end side of the nozzle 22 into a conical shape (in other words, the liquid is in a state of a taylor cone 60) at the distal end as illustrated in FIG. 6.

An action of an electric field causes a separation of positive/negative electric charges in the liquid and a meniscus at the distal end of the nozzle 22 charged by excess charge deforms, thus forming this taylor cone 60 into the conical shape. The liquid is drawn straight from the distal end of the taylor cone 60 by the electrostatic force and the liquid causes an electrostatic explosion at a distal end of a jet portion 60*a*, which linearly extends from the distal end of the taylor cone 60, thus spraying the liquid.

An attracting force by the electrostatic force in the direction perpendicular to the tangents of the equipotential curves 58 and the like until this electrostatic explosion occurs become an inertia force of the liquid to be sprayed. Furthermore, as a result of an interaction of an expansion force (a repulsion force) and the like during the electrostatic explosion, the liquid is sprayed to the front side.

Since this liquid to be sprayed, that is, the liquid separated from the nozzle 22 and becoming liquid particles dramatically increases an area in contact with the air compared with the area in the state before the separation, evaporation of solvent is promoted. A distance between electrons charged in association with the evaporation of the solvent becomes close, electrostatic repulsion (the electrostatic explosion) occurs, and the liquid is divided into the liquid particles with a small grain diameter. When this division occurs, the surface area in contact with the air further increases compared with the surface area before the division so that the evaporation of the solvent is promoted. In view of this, the liquid again causes the electrostatic explosion and is divided into the liquid particles with the small grain diameter, and repetition of such an electrostatic explosion causes the liquid to be atomized.

Here, the central rod 23 is disposed inside the nozzle 22 in this embodiment. Assuming that this central rod 23 is not disposed like the conventional electrostatic spray device, the part to which the liquid is attachable is only the distal end outer peripheral edge 22*a* of the nozzle 22.

In view of this, it is inferred that enlarging the opening diameter of the opening 22*b* of the nozzle 22 in such state fails to stably atomize the liquid. The reason is considered that, for example, the liquid is likely to swing to the upper, the lower, the right, and the left of the nozzle 22; therefore, the fair taylor cone 60 cannot be formed or the taylor cone 60 itself cannot be maintained. Such phenomenon fails to obtain stability (stability of the size and the number of particles, the charging state, and the like) of the liquid particles separated from the nozzle 22.

Meanwhile, this embodiment locates the central rod 23 inside the nozzle 22. Therefore, the liquid also attaches to the distal end surface 23*d* of the central rod 23 in addition to the distal end outer peripheral edge 22*a* of the nozzle 22. In other words, the distal end surface 23*d* of the central rod 23 to which the liquid is attachable is present at the center of the opening 22*b*. Accordingly, it is considered that even with the large opening diameter of the distal opening 22*b* of the nozzle 22, the stable taylor cone 60 can be formed, thereby ensuring the stable atomization of the liquid.

When the distal end surface 23*d* of the central rod 23 excessively protrudes forward from the distal end outer peripheral edge 22*a* (namely, the distal end surface of the distal opening 22*b* of the nozzle 22) of the nozzle 22, the electric field is less likely to act on the liquid coming out from the nozzle 22. Meanwhile, when the distal end surface 23*d* of the central rod 23 excessively recedes rearward from the distal end surface of the distal opening 22*b* of the nozzle 22, this results in a state equivalent to a state in which the part to which the liquid is attachable is absent at the center of the distal opening 22*b*.

Accordingly, in one embodiment, in the state of spraying the liquid, the distal end surface 23*d* of the central rod 23 is positioned within a range ten times the opening diameter of the distal opening 22*b* at the distal end of the nozzle 22 in the front-rear direction along the center axis of the central rod 23 with respect to the distal end surface of the distal opening 22*b* of the nozzle 22. In another embodiment, the distal end surface 23*d* of the central rod 23 is positioned within a range five times the opening diameter, and in yet another embodiment, the distal end surface 23*d* is positioned within a range three times the opening diameter.

For example, in this embodiment, the distal opening 22*b* of the nozzle 22 has the opening diameter of 0.2 mm, and when the electrostatic force is not taken into consideration, the liquid coming out from the distal opening 22*b* of the nozzle 22 comes out so as to have a hemispherical shape with the diameter of about 0.2 mm at the distal end of the nozzle 22.

In one embodiment, the distal end of the central rod 23 is present near this liquid such that the electric field (the electrostatic force) acts on the liquid coming out to the distal end of the nozzle 22 to ensure the formation of the conical-shaped taylor cone 60. In one embodiment, the distal end of the central rod 23 is positioned within 2 mm forward (the direction in which the liquid comes out) from the distal end surface of the distal opening 22*b* of the nozzle 22. Meanwhile, in one embodiment, the distal end surface 23*d* of the central rod 23 is positioned within 2 mm rearward (the receding direction) from the distal end surface of the distal opening 22*b* of the nozzle 22 such that the liquid attaches.

As described above, providing the central rod 23 ensures the stable atomization of the liquid even when the opening diameter of the distal opening 22*b* of the nozzle 22 is enlarged. In view of this, the opening diameter of the distal opening 22*b* of the nozzle 22 can be a large opening diameter by which the clogging can be suppressed. The opening diameter of the distal opening 22*b* of the nozzle 22 can be enlarged, thereby ensuring manufacturing the nozzle 22 through machining.

This embodiment describes the case where the distal end of the central rod 23 has the flat plane as the distal end surface 23*d*. However, note that the distal end of the central rod 23 does not always need to have the flat plane. For contribution to the formation of the stable taylor cone 60, for example, the distal end of the central rod 23 may have a curved surface projecting toward the front side such as a rounded shape.

Even the case of the use of the liquid spray unit 20 without the above-described stabilization electrode 30, when an amount of supplied liquid to the nozzle 22 is small (for example, the supply amount is around 0.1 milliliters/minute), the liquid can be successfully atomized even with viscosity of the liquid is low viscosity, for example, around 0.5 to 1000 mPa·s.

However, increasing the amount of supplied liquid makes it difficult to achieve the stable atomization of the liquid. In that case, the stabilization electrode 30 is used for stable atomization.

Therefore, the electrostatic spray device 10 of this embodiment includes the stabilization electrode 30. Consequently, when the amount of supplied liquid is increased so as to exceed 0.2 milliliters/minute by applying a pressure to the liquid, the successful atomization is possible even when the amount of supplied liquid is increased like, for example, 0.3 milliliters/minute, 0.5 milliliters/minute, 1.0 milliliter/minute, and further 2.0 milliliters/minute. The following further explains this stabilization electrode 30 in detail.

First, before the detailed explanation on the spraying of the liquid using the stabilization electrode 30, the following explains a reason that obtaining the stable atomization fails when the amount of supplied liquid is increased without the use of the stabilization electrode 30. After that, the following explains how the state where the stable atomization fails changes by the use of the stabilization electrode 30.

First, in the state without the use of the stabilization electrode 30, as illustrated in FIG. 5, the equipotential curves 58, which appear so as to surround the nozzle 22 by the application of the voltage, appear so as to draw circles around the nozzle 22. In this case, the attracting force of the electrostatic force works, when the tangents are drawn on these equipotential curves 58, in the direction perpendicular to these tangents. Accordingly, it is considered that the attracting force works on the liquid in a fan shape.

As described above, a principle of spraying the liquid from the electrostatic spray device is an electrostatic explosion of the liquid caused by the electrostatic force. In view of this, to increase the amount of supplied liquid, the applied voltage is raised according to the increase in the amount of supplied liquid, thus raising the generated electrostatic force. In this case, the liquid does not form the taylor cone 60 but is divided immediately close to the distal end of the nozzle 22 by the electrostatic force.

The following more specifically explains how the separation/atomization states of the liquid change with the increased electrostatic force for ease of understanding. When the electrostatic force is increased by raising the applied voltage from the successful state where the liquid causes the electrostatic explosion at the distal end of the jet portion 60*a*, which linearly extends from the distal end of the taylor cone 60, as illustrated in FIG. 6, the length of the jet portion 60*a* shortens. Furthermore, increasing the electrostatic force causes the jet portion 60*a* to disappear, and afterwards, even the taylor cone 60 is not formed. When entering this state, the division caused by the electrostatic force occurs immediately after the liquid comes out from the distal end of the nozzle 22.

As described above, when even the taylor cone 60 is not formed and the division occurs by the electrostatic force immediately close to the distal end of the nozzle 22, the particle diameter of the liquid does not become uniform unlike the case of causing the electrostatic explosion. Therefore, the atomization state becomes non-uniform where the liquid with the large particle diameter mixes with the liquid with the small particle diameter.

It is considered that since the electrostatic force is too strong relative to the amount of supplied liquid to be supplied in the state where even the taylor cone 60 is not formed and the division occurs by the electrostatic force immediately close to the distal end of the nozzle 22 as described above, the division by the electrostatic force instantly occurs. Accordingly, it is considered that increasing the amount of supplied liquid forms the taylor cone 60 and the jet portion 60*a* again.

Actually, when the amount of supplied liquid is increased, the formation of the taylor cone 60 and the jet portion 60*a* can be observed again. However, the jet portion 60*a* thus formed by increasing the amount of supplied liquid becomes thicker than the jet portion 60*a* formed through the stable atomization. Consequently, the variation is observed in the particle diameter of the liquid divided and atomized by the electrostatic explosion, failing to make the particle diameter of the liquid uniform.

It is considered that the thick jet portion 60*a* as described above is formed because the jet portion 60*a* is forcibly formed in a state where a force to pressure-feed the liquid from the nozzle 22 is also applied, rather than the jet portion 60*a* being formed so as to extend from the distal end of the taylor cone 60 mainly by the attracting force of the electrostatic force.

Here, considering that the electrostatic force is likely to act on the surface of the jet portion 60*a*, it is inferred that the thick jet portion 60*a* does not produce the uniform charging state of the jet portion 60*a*, and the jet portion 60*a* is in a state being charged more on the surface layer side. Then, since electric charges are not carried on the center portion of the jet portion 60*a* so much, the electrostatic force does not work, and meanwhile the surface layer of the jet portion 60*a* is possibly in the state on which the electrostatic force works.

As explained with reference to FIG. 5, without the use of the stabilization electrode 30, the electrostatic force works so as to draw the liquid in the fan shape. An attracting component of the electrostatic force drawing the liquid in this fan shape is expressible by a composition of a vector component in the Z-axis direction and a vector component in the X-axis direction in FIG. 5. Since the surface layer of the jet portion 60*a* faces the X-axis direction, the liquid on the surface layer of the jet portion 60*a* is likely to separate in the X-axis direction. Therefore, the liquid on the surface layer is divided from the jet portion 60*a* so as to be broken away by the vector component in the X-axis direction. It is inferred that this makes the particle diameter of the separated liquid unstable, producing the non-uniform particle diameters. It is inferred that this also makes the electrostatic explosion after the separation of the liquid non-uniform in association with the variation of the particle diameters of the liquid.

In view of this, the following is considered. For the stable atomization of the liquid absent of the variation of the particle diameters when the amount of supplied liquid is increased, the electrostatic force is caused to work so as to draw the liquid only in the Z-axis direction as much as possible. This increases the speed toward the distal end of the jet portion 60*a* while eliminating the surface division in the X-axis direction. The electrostatic force concentrates on the distal end of the jet portion 60*a* thus thinned (in other words, thinly extending long where the variation of the charging state is less likely to occur) and the uniform electrostatic explosion is generated.

Therefore, the inventors of the present invention have hit upon the configuration of providing the stabilization electrode 30 based on such way of thinking. Providing the stabilization electrode 30 allows an electrostatic spray device 10 of this embodiment to achieve stably spraying the liquid even when the liquid with comparatively low viscosity of around 0.5 to 1000 mPa·s is supplied to the nozzle 22 by the supply amount exceeding 0.2 milliliters/minute. Even when the pressure is applied to the liquid to supply the liquid to the nozzle 22, a state where the spraying is stable with the maximum grain diameter of the particle diameter in the spraying of 100 μm or less while the liquid is steady sprayed can be maintained. The following further explains the stabilization electrode 30 in detail.

As already explained with reference to FIG. 1, the electrical wiring branched from the electrical wiring coupling the voltage application unit 50 and the electrical wiring connecting portion 23*b* is coupled to the stabilization electrode 30. Therefore, the stabilization electrode 30 has an electric potential identical to that of the liquid spray unit 20 (the central rod 23 in this example). That is, the stabilization electrode 30 is configured so as to have the electric potential identical to that of the electrode (the central rod 23) of the liquid spray unit 20. In view of this, the stabilization electrode 30 generates action identical to the electrode (the central rod 23) of the liquid spray unit 20.

As illustrated in FIG. 1, since the stabilization electrode 30 having such electric potential is located so as to surround the outer periphery of the nozzle 22 at the distal end, the electrostatic force generated by the application of the voltage is also dispersed into the distal end surface 30*a* side of the stabilization electrode 30 and the concentration of the electrostatic force on the distal end of the nozzle 22 is reduced.

Consequently, even when the applied voltage is raised to increase the electrostatic force, the local concentration of the excessive electrostatic force to the liquid coming out from the nozzle 22 can be avoided. Accordingly, the division of the liquid immediately after coming out from the nozzle 22 is avoidable.

Figure 7:
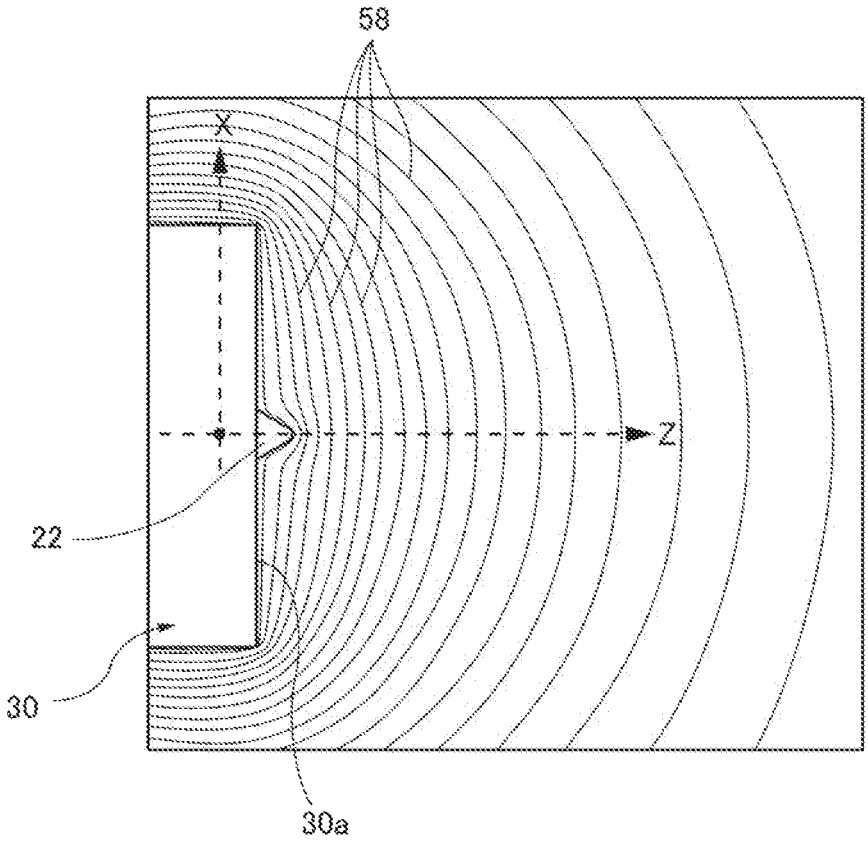
FIG. 7 is a drawing illustrating the equipotential curves when a voltage is applied with the stabilization electrode disposed in the electrostatic spray device of the first embodiment.

FIG. 7 illustrates a state of the equipotential curves 58, which appear with the stabilization electrode 30 provided, on an X-Z plane similar to that of FIG. 5. As illustrated in FIG. 7, a range including the distal end surface 30*a* of the stabilization electrode 30 becomes an electrode part where the electrostatic force gathers together. Accordingly, compared with FIG. 5, the curvature state of the equipotential curves 58 appearing on the front side of the nozzle 22 becomes gentle, intervals between the equipotential curves 58 widen, and the electrostatic force near the nozzle 22 weakens.

The electrostatic force acts so as to draw the liquid in the direction perpendicular to the tangents described on the equipotential curves 58. Thus, with the equipotential curves 58 as illustrated in FIG. 7, the drawing forces to the positive side and the negative side of the Z-axis become smaller than those of the equipotential curves 58 illustrated in FIG. 5. That is, this sets the state where the drawing force to the front side is increased, the intervals between the equipotential curves 58 widen, and the electrostatic force near the distal end of the nozzle 22 weakens.

Accordingly, the force drawing the liquid straight to the front side along the Z-axis, which does not cause the division at the distal end of the nozzle 22, is applied to the liquid coming out from the distal end of the nozzle 22. Accordingly, the liquid accelerates while extending to the front side, consequently becoming thin extending forward.

This distal end portion where the liquid is thinned is formed so as to extend the jet portion 60*a* long. In view of this, positioning the distal end portion at the position away from the stabilization electrode 30 facilitates the concentration of the electrostatic force, and further the thinned distal end portion also facilitates the concentration of the electrostatic force. The variation of the charging state is less likely to occur with the thinned distal end portion of the liquid. This is likely to cause the uniform electrostatic explosion.

This allows avoiding the partial division of the liquid in the jet portion 60*a*. Additionally, the liquid stably and uniformly causes the electrostatic explosion at the distal end of the jet portion 60*a*. Therefore, the non-uniform particle diameters of the liquid like in the case of without the use of the stabilization electrode 30 are less likely to occur.

It has been found that the distal end portion of the liquid extending forward works a self-adjustment function such that the distal end portion is at the position at which the uniform electrostatic explosion occurs by changing the distal end position of the jet portion 60*a* of the liquid according to, for example, the change in the electrostatic force caused by changes such as a change in the voltage of the voltage application unit 50 and a humidity change.

Specifically, the lowered voltage of the voltage application unit 50 weakens the electrostatic force due to the low voltage. In that case, since an influence from the stabilization electrode 30 is small at the distal end position of the jet portion 60*a* of the liquid, the extension of the distal end portion of the liquid forward where the electrostatic force is strong continues the stable atomization. Conversely, when the voltage of the voltage application unit 50 is raised, the voltage rise makes the electrostatic force strong. In that case, since the distal end position of the jet portion 60*a* of the liquid is largely affected by the stabilization electrode 30, decreasing the distal end portion of the liquid in size rearward where the electrostatic force is weak continues the stable atomization.

It can be confirmed that a variation width of the distal end position of the jet portion 60*a* is large and the stability of the electrostatic explosion is high when the length of the jet portion 60*a* (see FIG. 6) becomes longer than that before the stabilization electrode 30 is provided (i.e., longer than the length of an unenhanced jet portion 60*a* formed without the stabilization electrode 30).

In view of this, in one embodiment, the stabilization electrode 30 is disposed near the nozzle 22 such that the length of the jet portion 60*a* when the stabilization electrode 30 is provided becomes longer than the length of the jet portion 60*a* before the stabilization electrode 30 is provided by 1.5 times or more.

In one embodiment, the stabilization electrode 30 is disposed near the nozzle 22 such that providing the stabilization electrode 30 can provide the jet portion 60*a* even in the case where the jet portion 60*a* is hardly observed before the stabilization electrode 30 is provided. In other words, the length of the jet portion 60*a* becomes longer than that before the stabilization electrode 30 is provided.

It is considered that a level of contribution of the distal end surface 30*a* of the stabilization electrode 30 increases as the distal end surface 30*a* is positioned closer to the distal end side of the nozzle 22 and decreases as the distal end surface 30*a* is positioned further away from the distal end of the nozzle 22 rearward. Meanwhile, it is considered that in the case where the distal end surface 30*a* of the stabilization electrode 30 is positioned at the same distance from the distal end of the nozzle 22, the large area of the distal end surface 30*a* increases the area acting as the electrode. It is considered that this increases the level of contribution of the distal end surface 30*a*.

In view of this, it is considered that in the case where the distal end surface 30*a* of the stabilization electrode 30 is positioned on the distal end side of the nozzle 22, the stable electrostatic explosion (the spraying with small variation of the particle diameters) occurs even with the small area of the distal end surface 30*a*. Conversely, it is considered that in the case where the distal end surface 30*a* is positioned on the rear side with respect to the distal end of the nozzle 22, increasing the area of the distal end surface 30*a* ensures generating the stable electrostatic explosion (the spraying with the small variation of the particle diameters).

Therefore, some of the stabilization electrodes 30 including the distal end surfaces 30*a* whose sizes were changed were manufactured to obtain a relationship between the position of the nozzle 22 in the front-rear direction and the area of the distal end surface 30*a* for the distal end surface 30*a* by which the stable electrostatic explosion (the spraying with the small variation of the particle diameters) can be generated. The following further explains the area of the distal end surface 30*a* based on the relationship between the position of the nozzle 22 in the front-rear direction and the area of the distal end surface 30*a*.

First, while the liquid spray unit 20 is basically similar to the above-described one, a male screw structure (a spiral groove) is provided on the outer peripheral surface of the nozzle 22 for ease of positioning of the stabilization electrode 30 in the front-rear direction. Additionally, the liquid spray unit 20 includes the female screw structure (a spiral groove) on the inner peripheral surface of the through-hole 30*b* (see FIG. 2) of the stabilization electrode 30 where the nozzle 22 is to be located. That is, data explained later was obtained by the use of the electrostatic spray device 10 in which the position of the stabilization electrode 30 in the front-rear direction is changeable by the adjustment of the amount of screwing of the stabilization electrode 30 with respect to the nozzle 22.

As the stabilization electrodes 30, a cylindrical electrode with a diameter of 6 mm and an opening diameter of the distal end surface 30*a* for the nozzle 22 of 3.3 mm (hereinafter also referred to as an "electrode 1"), a cylindrical electrode with a diameter of 8 mm and an opening diameter of the distal end surface 30*a* for the nozzle 22 of 3.3 mm (hereinafter also referred to as an "electrode 2"), a cylindrical electrode with a diameter of 16 mm and an opening diameter of the distal end surface 30*a* for the nozzle 22 of 4.4 mm (hereinafter also referred to as an "electrode 3"), and a cylindrical electrode with a diameter of 28 mm and an opening diameter of the distal end surface 30*a* for the nozzle 22 of 4.4 mm (hereinafter also referred to as an "electrode 4") were each prepared. Then, a position (hereinafter also referred to as the maximum distance) on the rearmost side from the distal end of the nozzle 22 at which the stable electrostatic explosion (the spraying of the liquid with the stable particle diameter) was able to occur was obtained for each of the stabilization electrodes 30.

Consequently, a maximum distance L1 of the electrode 1 was 2 mm, and when the electrode 1 was located (the distal end surface 30*a* was located) on the rear side of the nozzle 22 further than that, the stable electrostatic explosion (the spraying of the liquid with the stable particle diameter) failed to occur. Similarly, a maximum distance L2 of the electrode 2 was 2.5 mm, a maximum distance L3 of the electrode 3 was 3.5 mm, and a maximum distance L4 of the electrode 4 was 4.5 mm.

Here, areas S ($mm^2$) of the distal end surfaces 30*a* of the electrodes 1 to 4 are obtained by $S=[(D/2)^2-(d/2)^2]\times\pi$ from a diameter D and an opening diameter d of the distal end surface 30*a*. Because of the presence of changes in units of mm, the areas S were obtained in the unit of μm considering the consequences. An area S1 of the distal end surface 30*a* of the electrode 1 was 19711350 ($\mu m^2$), an area S2 of the distal end surface 30*a* of the electrode 2 was 41691350 ($\mu m^2$), an area S3 of the distal end surface 30*a* of the electrode 3 was 185762400 ($\mu m^2$), and an area S4 of the distal end surface 30*a* of the electrode 4 was 600242400 ($\mu m^2$).

It is inferred that, considering that the stabilization electrode 30 acts on the electrostatic force, the changes from these areas S1 to S4 receives an influence in association with squares of the maximum distances L1 to L4, that is, the areas have a tendency to increase the areas in proportion to the squares of the distances.

Therefore, the areas S1 to S4 were divided by the squares of the maximum distances L1 to L4 to obtain areas from which the influences by the squares of the distances were canceled (note that, to match the unit with the unit of the areas S1 to S4, the division by the square of the distance was calculated using μm as the unit for L1 to L4). This area obtained by the division by the square of the distance is referred to as a divided-back area (note that since the divided-back area itself is a value normalized so as to cancel the change in the distance, the unit is dimensionless).

Thus, a divided-back area SD1 of the electrode 1 was obtained as 4.93, a divided-back area SD2 of the electrode 2 was obtained as 6.67, a divided-back area SD3 of the electrode 3 was obtained as 15.16, and a divided-back area SD4 of the electrode 4 was obtained as 29.64.

Here, in the case where the influence simply follows the square of the distance (usually, a force related to an electromagnetic field such as the electrostatic force follows the square of the distance), each of the divided-back areas SD1 to SD4 should be a constant. However, each of the divided-back areas SD1 to SD4 is not a constant in the above-described calculations. Specifically, in a graph created with the maximum distances L1 to L4 as values of an X-axis on the graph and the divided-back areas SD1 to SD4 as values of a Y-axis on the graph, a continuously growing tendency in an exponential manner can be seen.

It is considered that this occurs because, although these divided-back areas SD1 to SD4 become the values from which the influence by the difference in the position of the distal end surface 30*a* of the stabilization electrode 30 along the nozzle 22 is canceled, the divided-back areas SD1 to SD4 become the values where the influence brought by the distance being away from the center of the nozzle 22 remains as the diameter enlarges even at the identical position.

That is, in the case where the large-area electrode surface (distal end surface 30*a*) is to be configured, the diameter of the stabilization electrode 30 inevitably enlarges when the distal end surface 30*a* of the stabilization electrode 30 is moved rearward from the distal end of the nozzle 22. The above-described continuously growing tendency in the exponential manner is probably affected by this configuration.

Accordingly, it is considered that the function obtained by plotting these maximum distances L1 to L4 as the values of the X-axis on the graph and the divided-back areas SD1 to SD4 as the values of the Y-axis on the graph, and approximating these values by an exponential expresses the influence by the change in the diameter of the distal end surface 30*a* of the stabilization electrode 30 according to the distance from the distal end of the nozzle 22.

Obtaining the exponential based on the four sample points (L1, SD1), (L2, SD2), (L3, SD3), and (L4, SD4) plotted on the graph (as the X coordinate, the Y coordinate) where a variable of the X-axis on the graph is L and a variable of the Y-axis is SD can obtain the following formula F1 (note that the following approximation formula (F1) was obtained using a function of Excel).

$$SD=1.1191\times[\mathrm{EXP}(0.00073\times L)] \quad \text{(F1)}$$

The function (the formula (F1)) obtained by this approximation is a formula indicating the relationship between the distance L (μm) from the distal end of the nozzle 22 and the divided-back area (SD) required for the distance L (μm). That is, assigning any distance L (μm) from the distal end of the nozzle 22 to L in the formula (F1) obtains the divided-back area SD required at that position. Then, multiplying this obtained divided-back area SD by the square of the distance L (μm) such that the divided-back area SD obtained using the formula (F1) becomes the state before this dividing-back is performed obtains the area S ($\mu m^2$) required for the distance L (μm).

Accordingly, in one embodiment, when the distance from the distal end of the nozzle 22 to the distal end surface 30*a* of the stabilization electrode 30 is L (μm), the area S ($mm^2$) of the distal end surface 30*a* of the stabilization electrode 30 is set to be the area S ($mm^2$) obtained by the following formula (F2) or more.

$$S=\{L^2\times(1.1191\times[\mathrm{EXP}(0.00073\times L)])\}/10^6 \quad \text{(F2)}$$

Note that the reason for the formula (F2) performing the division by $10^6$ is to return the unit of the area S to $mm^2$.

In view of this, the exponential part is expressed as a function F(L) as follows.

$$F(L)=1.1191\times[\mathrm{EXP}(0.00073\times L)]$$

In one embodiment, when the distance from the distal end of the nozzle 22 to the distal end surface 30*a* of the stabilization electrode 30 is the distance L (μm), the area S ($mm^2$) of the distal end surface 30*a* meets the following formula (1).

$$S\geq[L^2\times F(L)]/10^6 \quad (1)$$

Note that $F(L)=1.1191\times[\mathrm{EXP}(0.00073\times L)]$ and when $L\leq1.0$, $L=1.0$.

The reason that L=1.0 (μm) is set in the case of $L\leq1.0$ (μm) is as follows. As apparent from the above-described development of the formula, the part of $L^2$ is a factor to cancel the influence from the distance from the distal end of the nozzle 22. That is, the part of $L^2$ is a denominator to obtain the divided-back area SD and is a physical quantity required to be a value larger than 1.0 as separating away from the nozzle 22.

However, with $L<1.0$, the part of $L^2$ becomes a calculational singular point taking a value less than 1.0. In the range of this singular point, a theoretically incorrect calculation result is acquired where the closer the stabilization electrode 30 to the distal end of the nozzle 22 is, the larger the area of the distal end surface 30*a* is.

Meanwhile, it is considered that there is no substantial difference between the position rearward from the distal end of the nozzle 22 by 1 μm and the position at the distal end. Therefore, it is considered that, regarding (L≤1.0) as L=1.0 does not cause a problem practically in the range of 1.0 μm from the distal end of the nozzle 22, which becomes the calculational singular point. In view of this, L=1.0 (μm) is set in the case of L≤1.0 (μm).

Providing the stabilization electrode 30 facilitates causing only the force straight drawing the liquid coming out from the distal end of the nozzle 22 forward to act. In this case, since the electrostatic force is dispersed on the distal end surface 30*a* of the stabilization electrode 30, the force drawing the liquid itself decreases.

In view of this, to provide the liquid with the electrostatic force for extending the liquid forward properly, the area of the distal end surface 30*a* of the stabilization electrode 30 is 1250 $mm^2$ or less in one embodiment, 960 $mm^2$ or less in another embodiment, and 700 $mm^2$ in yet another embodiment.

Reducing the area of the distal end surface 30*a* of the stabilization electrode 30 to the above-described area prevents the electrostatic force applied to the liquid from excessively weakening. Consequently, the jet portion 60*a* where the liquid properly extends forward can be formed.

Considering the dispersion of the electrostatic force on the distal end surface 30*a* of the stabilization electrode 30, to obtain the electrostatic force to the extent of the liquid properly extending forward, the applied voltage is 10 kV or more in one embodiment and 15 kV or more in another embodiment. In view of this, in the one embodiment, the voltage application unit 50 in the electrostatic spray device 10 can apply the voltage of 10 kV or more.

Meanwhile, considering the prevention of excessive application of the electrostatic force to the liquid and safety, the applied voltage is 30 kV or less in one embodiment, 25 kV or less in another embodiment, and 20 kV or less in yet another embodiment.

Figure 8:
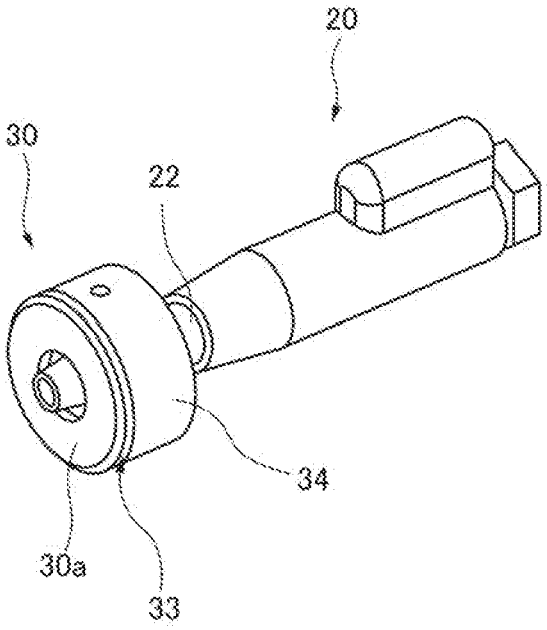
FIG. 8 is a perspective view of a liquid spray unit with a stabilization electrode of a modification disposed in the electrostatic spray device of the first embodiment.

Furthermore, in the foregoing, the entire stabilization electrode 30 is made from a conductive material, that is, not only the distal end portion substantially contributing as the electrode including the distal end surface 30*a* of the stabilization electrode 30, but all including the part on the rear side with respect to the distal end portion is integrally made from the conductive material. Note that the part of the distal end surface 30*a* actually contributes to the stable atomization. Therefore, the stabilization electrode 30 may be configured as a modification as illustrated in FIG. 8.

That is, the stabilization electrode 30 may include a distal end portion 33, which includes the planar distal end surface 30*a* functioning as the electrode part of the stabilization electrode 30 and made from the conductive material, and a part 34, which is integrally formed with the distal end portion 33 at the rear of the distal end portion 33 and is made from an insulating material. Thus thinning the thickness of the part made from the conductive material ensures suppressing an occurrence of a spark. The thickness of the part made from the conductive material is 10 mm or less in one embodiment, and 5 mm or less in another embodiment.

Further, while the distal end surface 30*a* with the circular outer shape has been described above, the outer shape of the distal end surface 30*a* may be a polygon such as a pentagon and a hexagon. For example, configuring the outer shape of the distal end portion 33, which is the part made from the conductive material and including the distal end surface 30*a*, into the polygon such as the pentagon and the hexagon ensures easily configuring the outer shape of the distal end surface 30*a* into the pentagon and the hexagon. In this case, the outer shape of the distal end surface 30*a* and the outer shape of the distal end portion 33 are approximately identical to each other.

Note that positioning the distal end surface 30*a* of the stabilization electrode 30 at a position excessively away from the distal end of the nozzle 22 rearward requires considerably large area of the distal end surface 30*a*, and the effect of stabilization is less likely to be provided. In view of this, in one embodiment, the distal end surface 30*a* of the stabilization electrode 30 is positioned within 8 mm from the distal end of the nozzle 22.

To dispose the nozzle 22, an opening is provided at the distal end surface 30*a* of the stabilization electrode 30. The large opening means that an inner peripheral edge of the distal end surface 30*a* functioning as the electrode surface is away from the nozzle 22. It is considered that this facilitates the appearance of the equipotential curves 58 curved to the rear side in a clearance between this inner peripheral edge and the nozzle 22. This clearance may be set to be small such that such equipotential curves 58 are less likely to appear. Accordingly, the opening diameter of the distal end surface 30*a* is around within 7 mm in one embodiment, around within 6 mm in another embodiment, and around within 5 mm in yet another embodiment.

Second Embodiment

The first embodiment has been described the planar distal end surface 30*a* of the stabilization electrode 30. In one embodiment, the stabilization electrode 30 has a shape by which the electrostatic force applied to the distal end of the nozzle 22 is uniformly dispersed to its peripheral area.

Thus, the distal end surface 30*a* of the first embodiment is formed into the planar shape. Meanwhile, the stabilization electrode 30 of the second embodiment has a tapered shape whose outer diameter increases from the distal end side to the rear side. It is considered that such configuration also can obtain the effect to disperse the electrostatic force applied to the distal end of the nozzle 22 into its peripheral area. The following explains the tapered stabilization electrode 30.

Figure 9A:
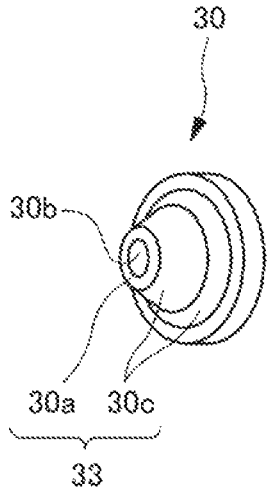
FIG. 9A is a perspective view illustrating a stabilization electrode of a second embodiment according to the present invention.
Figure 9B:
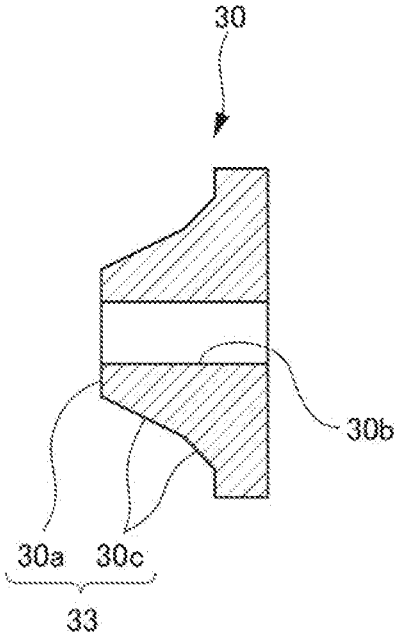
FIG. 9B is a cross-sectional view illustrating the stabilization electrode of the second embodiment according to the present invention.

FIG. 9A is a perspective view illustrating the stabilization electrode 30 of the second embodiment, and FIG. 9B is a cross-sectional view illustrating the stabilization electrode 30 of the second embodiment.

As illustrated in FIG. 9A and FIG. 9B, the stabilization electrode 30 of the second embodiment includes a distal end portion 33. This distal end portion 33 includes a distal end surface 30*a* and an inclined part 30*c*, which is inclined such that the outer shape enlarges from the distal end surface 30*a* side toward the rear side. In this embodiment, the inclined part 30*c* has a tapered shape in two stages. However, the inclined part 30*c* needs not to be the tapered shape in the two stages but may be a tapered shape in three stages.

It is considered that, with such tapered shape part, not only the distal end surface 30*a* but also the surface of the inclined part 30*c* contributes to the dispersion of the electrostatic force gathering together at the distal end of the nozzle 22.

More specifically, it is considered that the part of the surface that can be seen from the distal end side of the nozzle 22 contributes as the electrode. In view of this, a part having a sufficient diameter that can contribute as the stabilization electrode 30 may be disposed in a range within a distance of approximately 8 mm from the distal end of the nozzle 22 in the front view viewing the distal end of the nozzle 22 as the front.

It is considered that, for example, in FIGS. 9A and 9B, even when the taper angle of the tapered part on the first stage on the distal end surface 30*a* side is gentle, the diameter does not largely change toward the rear side so much, and a cross-sectional surface of any part in the range from the distal end surface 30*a* to the tapered part on the first stage does not have a size (a diameter) by which the required area according to the distance from the distal end of the nozzle 22 is obtained, as long as the taper angle of the tapered part on the second stage is large and has the rapidly enlarged diameter so as to have the size (the diameter) by which the required area according to the distance from the distal end of the nozzle 22 is obtainable by the tapered part on the second stage, the electrostatic force gathering together at the distal end of the nozzle 22 can be sufficiently dispersed.

Accordingly, the second embodiment may modify the area represented by the formula (1) described in the first embodiment as follows. That is, when a cross-sectional area of a cross section when the distal end portion 33 of the stabilization electrode 30 positioned within 8 mm from the distal end of the nozzle 22 is cut off at any position in the center axis direction of the nozzle 22 is SS ($mm^2$) and a distance from the distal end of the nozzle 22 to the cross section is LL (μm), the distal end portion 33 positioned within 8 mm from the distal end of the nozzle 22 may include a part having the cross-sectional area SS ($mm^2$) meeting the formula (2).

$$SS \geq [LL^2 \times F(LL)]/10^6 \quad (2)$$

Note that F(LL)=1.1191×EXP(LL×0.00073), and when LL≤1.0, LL=1.0.

To obtain this cut-off area, obtaining the outer shape as the outer shape at the position of obtaining the cut-off area and obtaining the diameter at the through-hole part where the nozzle 22 is positioned as the opening diameter of the distal end surface 30*a* of the stabilization electrode 30 lead to further accurate calculation, rather than obtaining the cut-off area actually cut off at the position; therefore, the values are thus obtained.

Because, even when the diameter of the through-hole to dispose the nozzle 22 is a diameter larger than the opening diameter of the distal end surface 30*a* inside the stabilization electrode 30, this does not affect the surface area of the external surface of the stabilization electrode 30.

To prevent attracting force drawing the liquid from excessively weakening, the cross-sectional area SS ($mm^2$) of the part with the largest outer shape positioned within 8 mm from the distal end of the nozzle 22 is 1250 $mm^2$ or less in one embodiment, 960 $mm^2$ or less in another embodiment, and 700 $mm^2$ or less in yet another embodiment.

In the second embodiment as well, the distal end surface 30*a* has the circular outer shape and the inclined part 30*c* also has the conical shape corresponding to the circular shape. Note that the distal end surface 30*a* may have a pentagon or a hexagon shape, and the inclined part 30*c* may also have a corresponding shape such as a pentagonal pyramid and a hexagonal pyramid.

While the present invention has been explained based on the specific embodiments, the present invention is not limited to the above-described embodiments and may be modified and improved as necessary. Since the electrostatic spray device 10 of this embodiment is configured to supply the nozzle 22 with much liquid to increase the sprayed amount of the liquid to be sprayed, the pressure may be applied to the liquid to supply this liquid in order to supply the much liquid to the nozzle 22. Accordingly, the electrostatic spray device 10 may include a liquid supply unit that applies a pressure to the liquid to supply the nozzle 22 with the liquid.

The supplied amount of the liquid to be supplied may be 0.2 milliliters/minute or more in one embodiment and may be 0.5 milliliters/minute or more in another embodiment. Meanwhile, to obtain the highly stable spraying state of the liquid, the supplied amount of the liquid to be supplied may be 3.0 milliliters/minute or less in one embodiment, 2.5 milliliters/minute or less in another embodiment, and may be 2.0 milliliters/minute or less in yet another embodiment.

Thus, the present invention is not limited to the specific embodiments, and ones modified and improved as necessary are also encompassed in the technical scope of the present invention, which are apparent for the person skilled in the art from the description of the claims.

REFERENCE SIGNS LIST

10 electrostatic spray device
20 liquid spray unit
21 body
21*a* liquid supply port
21*b* liquid flow passage
21*c* hole portion
21*d* rear end opening
21*e* female screw structure
22 nozzle
22*a* distal end outer peripheral edge
22*b* opening
23 central rod
23*a* knob portion
23*b* electrical wiring connecting portion
23*c* male screw structure
23*d* distal end surface
24 sealing member
30 stabilization electrode
30*a* distal end surface
30*b* through-hole
30*c* inclined part
31 fixation screw
31*a* screw hole
33 distal end portion
40 heteropolar portion (coated object)
50 voltage application unit
58 equipotential curve
60 taylor cone
60*a* jet portion
80 grounding portion

The invention claimed is:

1. An electrostatic spray device comprising:

a liquid spray unit including a nozzle configured to spout a liquid;

a voltage application unit configured to apply a voltage between the liquid spray unit and a heteropolar portion functioning as a pole opposite from a pole of the liquid spray unit to generate a liquid spray from the liquid spray unit, the liquid spray having a taylor cone at a distal end of the nozzle, the voltage application unit being further configured to apply the voltage between the liquid spray unit and the heteropolar portion to separate the liquid at a distal end of a jet portion of the liquid spray, the jet portion linearly extending from a distal end of the taylor cone to atomize the liquid by an electrostatic explosion; and a stabilization electrode configured to maintain a stable spraying state of the liquid spray in which the liquid is stably sprayed with a maximum liquid particle grain diameter of 100 μm or less in a steady spraying even when a pressure is applied to the liquid to supply the nozzle with the liquid;

wherein the stabilization electrode:

has an electric potential identical to an electric potential of the liquid spray unit; and is disposed at a position such that a distal end of the stabilization electrode is located rearward of the distal end of the nozzle to form the jet portion having a length longer than a length of an unenhanced jet portion formed without the stabilization electrode.

2. The electrostatic spray device according to claim 1, wherein the stabilization electrode lengthens the jet portion by 1.5 times or more compared with the length of the unenhanced jet portion without the stabilization electrode.

3. The electrostatic spray device according to claim 1, wherein the stabilization electrode is configured to maintain the stable spraying state even when the pressure applied to the liquid to supply the nozzle with the liquid exceeds 0.2 milliliters per minute.

4. The electrostatic spray device according to claim 1, wherein the stabilization electrode is configured to maintain the stable spraying state even when the pressure is applied to the liquid to supply the nozzle with the liquid having a viscosity of 0.5 Pa·s or more and 1000 mPa·s or less.

5. The electrostatic spray device according to claim 1, wherein the voltage application unit is configured to apply a voltage of 10 kV or more.

6. The electrostatic spray device according to claim 1, wherein the stabilization electrode includes a distal end portion having:

an approximately planar distal end surface; and a part having an outer shape approximately identical to an outer shape of the distal end surface from a side of the distal end surface to a rear side of the distal end portion.

7. The electrostatic spray device according to claim 6, wherein, when a distance from the distal end of the nozzle to the distal end surface of the stabilization electrode is L (μm) and an area of the distal end surface of the stabilization electrode is S ($mm^2$), a formula below is met:

$$S \geq [L^2 \times F(L)]/10^6$$

(wherein $F(L)=1.1191 \times EXP(L \times 0.00073)$ and when $L \leq 1.0$, $L=1.0$).

8. The electrostatic spray device according to claim 7, wherein the area S is 1250 $mm^2$ or less, and the distal end surface of the stabilization electrode is at a position of the distance L (μm) meeting the formula (1) from the distal end of the nozzle.

9. The electrostatic spray device according to claim 8, wherein the area S is 960 $mm^2$ or less.

10. The electrostatic spray device according to claim 8, wherein the area S is 700 $mm^2$ or less.

11. The electrostatic spray device according to claim 1, wherein the stabilization electrode includes a distal end portion having:

a distal end surface; and an inclined part inclined such that an outer diameter increases from the distal end surface side to a rear side of the distal end portion.

12. The electrostatic spray device according to claim 11, wherein:

at least a part of the distal end portion of the stabilization electrode is positioned within 8 mm from the distal end of the nozzle, and when a cross-sectional area of a cross section when the distal end portion of the stabilization electrode positioned within 8 mm is cut off at any position in a center axis direction of the nozzle is SS ($mm^2$) and a distance from the distal end of the nozzle to the cross section is LL (μm), the distal end portion positioned within 8 mm from the distal end of the nozzle includes a part having the cross-sectional area SS ($mm^2$) meeting a formula (2) below:

$$SS \geq [LL^2 \times F(LL)]/10^6$$

(wherein $F(LL)=1.1191 \times EXP(LL \times 0.00073)$ and when $LL \leq 1.0$, $LL=1.0$).

13. The electrostatic spray device according to claim 12, wherein the cross-sectional area SS ($mm^2$) at a largest outer diameter of the distal end portion of the stabilization electrode positioned within 8 mm is 1250 $mm^2$ or less.

14. The electrostatic spray device according to claim 12, wherein the cross-sectional area SS ($mm^2$) at a largest outer diameter of the distal end portion of the stabilization electrode positioned within 8 mm is 960 $mm^2$ or less.

15. The electrostatic spray device according to claim 12, wherein the cross-sectional area SS ($mm^2$) at a largest outer diameter of the distal end portion of the stabilization electrode positioned within 8 mm is 700 $mm^2$ or less.

16. The electrostatic spray device according to claim 1, further comprising a liquid supply unit configured to apply the pressure to the liquid to supply the nozzle with the liquid.

17. The electrostatic spray device according to claim 1, wherein the stabilization electrode is disposed such that an inner peripheral edge of the distal end of the stabilization electrode is located near the distal end outer peripheral edge of the nozzle.

18. The electrostatic spray device according to claim 17, wherein the stabilization electrode is disposed at a position such that a distal end of the stabilization electrode is located rearward of an outer peripheral edge of the distal end of the nozzle.

19. The electrostatic spray device according to claim 1, wherein the stabilization electrode is disposed at a position such that a distal end of the stabilization electrode is located rearward of an outer peripheral edge of the distal end of the nozzle.

* * * * *